US007237425B1

(12) United States Patent
Wadsworth

(10) Patent No.: US 7,237,425 B1
(45) Date of Patent: Jul. 3, 2007

(54) HINGE REPAIR TOOL

(76) Inventor: Richard D. Wadsworth, 300 Hoffman Ave., Vestal, NY (US) 13901

( * ) Notice: Subject to any disclaimer, the term of this patent is extended or adjusted under 35 U.S.C. 154(b) by 0 days.

(21) Appl. No.: 11/494,255

(22) Filed: Jul. 27, 2006

(51) Int. Cl.
*B21D 9/08* (2006.01)
*B25B 7/02* (2006.01)
*B25B 1/20* (2006.01)

(52) U.S. Cl. ..... 72/409.12; 72/479; 81/303; 81/381; 81/418; 269/43; 269/154

(58) Field of Classification Search ..... 72/409.12, 72/479; 81/303, 381, 418, 420; 269/43, 269/154
See application file for complete search history.

(56) References Cited

U.S. PATENT DOCUMENTS 2,440,820 A * 5/1948 Frank ..... 269/154
2,661,783 A * 12/1953 Caston ..... 269/154
2,836,139 A * 5/1958 Holmberg ..... 269/45
4,299,146 A * 11/1981 Phelps ..... 81/420
4,386,543 A * 6/1983 Walker, Jr. ..... 269/265
D297,103 S * 8/1988 Parish, Sr. ..... D8/52
5,435,030 A * 7/1995 Phillips ..... 29/283.5
5,482,263 A * 1/1996 Kutzleb ..... 269/41
6,032,333 A 3/2000 Brustle
6,257,101 B1 * 7/2001 Marlette et al. ..... 81/165
6,532,626 B2 3/2003 Muller et al.
6,776,403 B1 * 8/2004 Neufeld ..... 269/152

* cited by examiner

*Primary Examiner*—David Jones
(74) *Attorney, Agent, or Firm*—Mark Levy & Associates, PLLC

(57) ABSTRACT

The present invention is a hinge repair tool constructed from two, spaced apart pairs of modified vise grip or wrench pliers. A single, elongated, upper bar is connected to the respective top jaws of each of the pairs of pliers. Two lower bars are also connected to respective lower jaws of the two pairs of pliers. Each of the pairs of pliers is operative independently of one another, so that each of the respective lower bars can be repositioned relative to the common upper bar. The lower bars are separated from one another and a gap is formed therebetween. A rigid bar is connected to the handles of the two pairs of pliers to provide additional stability. The vise grip pliers each include a mechanism for locking the lower jaw relative to the upper jaw thereof.

14 Claims, 4 Drawing Sheets

HINGE REPAIR TOOL

FIELD OF THE INVENTION

The present invention pertains to hand tools and, more particularly, to a hand tool for repositioning and repairing door hinges.

BACKGROUND OF THE INVENTION

One of the earliest structural components of civilized man was the swinging door. In order to provide privacy and to exclude the elements and unwanted intruders, animals and insects from living quarters, swinging doors are now common features of buildings. Doors are disposed both externally and internally to buildings such as houses, office buildings, factories, hospitals, warehouses, theaters, and schools. Even twenty-first century doors that open and close quickly, quietly and automatically by sensing the presence of a person proximate thereto are most often swinging doors.

Historically, the preferred mechanism for effecting the swinging door operation is the hinge, which movably connects the door to its door frame. The standard hinge comprises two metal plates or leaves, each having a number of apertures (screw or nail holes) formed therein. A swiveling mechanism, such as a slip pin, cup and ball, or spiral elevator device, which may be spring-loaded, connects the two metal leaves. Conventionally, two or more hinges are spaced apart along one longitudinal border of a door in order to provide stability. It is not unusual to encounter more than two hinges disposed on a door and door frame, depending upon the size and weight of the door that is supported thereby.

Over a period of time, especially when a door is opened and closed frequently and most often when the door itself is massive, as in the case of external doors and steel doors, the screws or nails securing the metal leaves to the door and/or door frame can shift position and misalign relative to the structures they support. In the case of wooden doors and door frames, changes in heat and humidity are also the cause for such shifting and misaligning. When this misalignment occurs, the door may "stick" to the door frame, making it difficult to open the door, once closed. In extreme situations, the door may not close entirely.

Heretofore, the solution to the shifting and misalignment problem has been to remove one or both leaves of the hinge and replace or reseat the hinge with new, usually larger screws. Wood putty or filler was employed, when necessary.

Repositioning the hinge(s) relative to the door and door frame was another, more time-consuming option. What is needed is a tool for adjusting the hinge relative to the door and door frame.

DISCUSSION OF THE RELATED ART

A product marketed under the trademark, "Hinge Doctor," manufactured by GKL Products of Freemont, Calif., comprises a slotted aluminum tube that slips over the hinge to be repaired. By opening the door and using the leverage thereof, the aluminum bends the hinge but in the process, imparts stress to the hinge pocket. A plurality of tube sizes is required to accommodate different sized hinges.

U.S. Pat. No. 6,532,626, granted to Muller, et al. on Mar. 18, 2003 for ADJUSTABLE HINGE, discloses an adjustable hinge that connects two furniture components (door and cabinet body) together by means of a cabinet hinge and base plate. On the cabinet hinge is a spring snap mechanism and a hinge arm connected by an adjustment plate with the base plate. Between the hinge arm and the adjustment plate, a screw is located to adjust both distances. The adjustment screw is designed as a set screw or thread pin that has on its one end a device for a releasable coupling with a tool and on the other end has a plate with a larger diameter. The bottom surface side of the plate thus rests on the base plate and on the plate's upper surface. The adjustable hinge allows adjustment of lateral distances between the door and cabinet.

U.S. Pat. No. 6,032,333, granted to Brustle on Mar. 7, 2000 for HINGE, discloses a hinge mounted to a door on an article of furniture. A base plate is mounted on the article of furniture and an intermediate member is mounted on the base plate by a spring mechanism. A hinge arm is connected to the intermediate member for adjustment relative thereto. A mechanism to selectively adjust the hinge arm relative to the intermediate member in a direction longitudinally of the intermediate member includes plural projections on the intermediate member, the projections being spaced longitudinally thereof.

None of these patents or product, individually or in any combination, is seen to teach or suggest a tool for repairing or adjusting the position of a door hinge of the present invention.

It is an object of the invention to provide a tool for repairing door hinges.

It is another object of the invention to provide a hinge repair tool that is hand-operated and portable.

It is yet another object of the invention to provide a hinge repair tool that can operate on a variety of hinges, irrespective of the sizes thereof.

It is still another object of the invention to provide a hinge repair tool that can be used without disassembling or partially disassembling the hinge from the door or door frame.

It is a further object of the invention to provide a hinge repair tool that can adjust hinges of a door without affecting or damaging the hinge pocket.

It is another object of the invention to provide a hinge repair tool that can be operated by a single maintenance person or carpenter.

SUMMARY OF THE INVENTION

The present invention is a hinge repair tool. A first pair of modified vise grip or wrench pliers has a top jaw, a bottom jaw and a handle. Moreover, a second pair of modified vise grip pliers also has a top jaw, a bottom jaw and a handle. The second pair of pliers is spaced apart from and parallel to the first pair of vise grip pliers. A planar, rigid, upper member is connected to the respective top jaws of each of the pairs of pliers. Planar, rigid lower members are also connected to respective lower jaws of the two pairs of pliers. Each of the pairs of pliers is operative independently of one another, so that each of the respective lower members of each of the pliers can be repositioned relative to the upper member. The rigid lower members are separated from one another and a gap is formed therebetween for ease of operation. A rigid member is connected to the handles of the first and second pairs of pliers, respectively, to provide additional stability. The vise grip pliers include a mechanism for locking the lower jaw relative to the upper jaw thereof.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE PREFERRED EMBODIMENT

The invention is a hinge repair tool constructed from two, spaced apart pairs of modified vise grip pliers. A single, elongated, upper bar is connected to the respective top jaws of each of the pairs of modified vise grip pliers. Lower bars are also connected to respective lower jaws of the two pairs of modified vise grip pliers. Each of the pairs of modified vise grip pliers is operative independently of one another, so that each of the respective lower bars can be repositioned relative to the upper bar.

Figure 1:
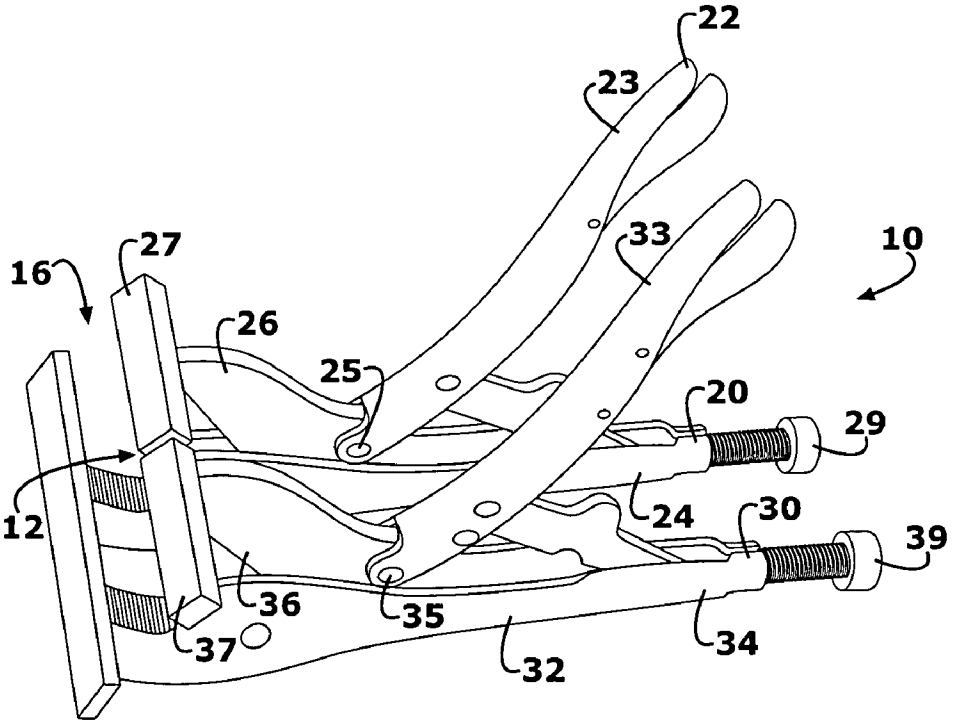
FIG. 1 is a perspective view of the hinge repair tool of the present invention in its open position.

Referring now to FIG. 1, there is shown a perspective view of the hinge repair tool of the present invention generally at reference numeral 10. The repair tool 10 is fabricated from metal, as is well known in the art of tool making. A first and second standard pair of vise grip or wrench pliers 20 and 30, respectively, are modified as described hereinbelow. First pair of pliers 20 is disposed in spaced apart and parallel relationship to second pair of pliers 30, as shown.

The handle 22 of first pair of pliers 20 has two legs 23, 24. The lower leg 23 is stationary and the upper leg 24 is movable relative thereto. Similarly, the handle 32 of second pair of pliers 30 has two legs 33, 34. The lower leg 22, 34 is stationary and the upper leg 23, 33 is movable relative thereto. In FIG. 1, both movable legs 23, 33 are shown in their open position. A locking mechanism 29, 39 is provided for each handle 22, 32, respectively, as is provided with conventional vise grip pliers and which operates in a conventional manner.

Connected to the distal end of movable legs 23, 33 is a pivot pin 25, 35, respectively, to which is also connected a translation member 26, 36, respectively, that terminates in a lower jaw, not shown in this FIG. 1. Attached to each lower jaw of both pairs of pliers 20, 30 is a rigid, longitudinal member or bar 27, 37, respectively. Bars 27, 37 are attached to the respective jaws of each pair of pliers 20, 30 preferably by welding, although other means of attaching the components to one another are contemplated within the scope of the invention, including gluing, screwing, bolting, and crimping.

A space or gap 12 is formed between bars 27, 37 to facilitate independent operation of each of the pairs of pliers 20, 30.

Figure 2:
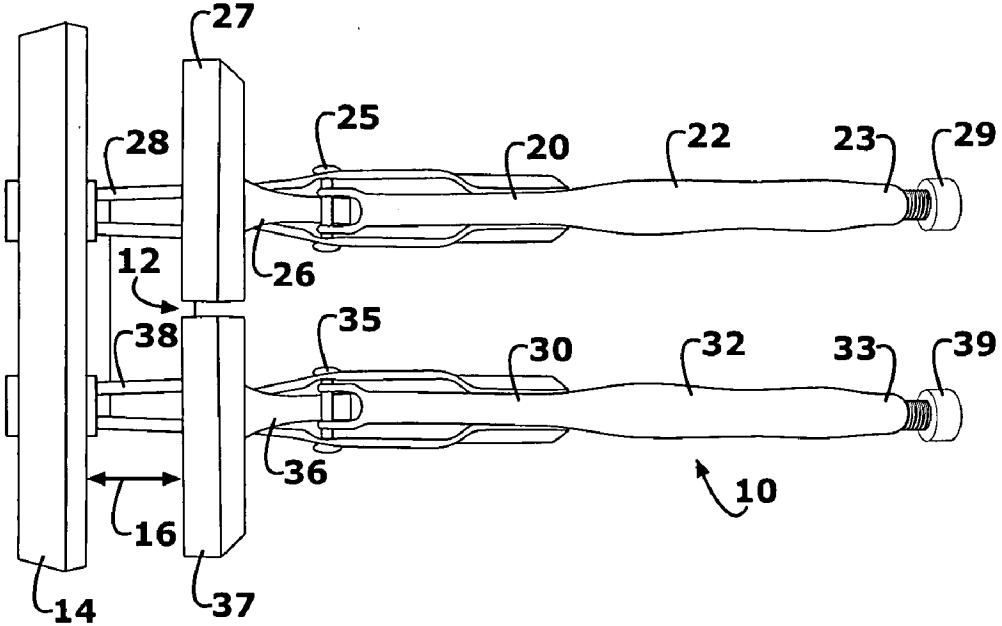
FIG. 2 is a plan view of the front of the hinge repair tool shown in FIG. 1.

Referring now also to FIG. 2, there is shown a plan view of the front of the hinge repair tool 10, also in its completely open position. A single, rigid, elongated upper bar 14 is attached to both upper jaws 28, 38 of the two pairs of pliers 20, 30, preferably by welding, although other means of attaching the components to one another are contemplated within the scope of the invention, including gluing, screwing, bolting, and crimping.

The size of the opening 16 between upper bar 14 and lower bars 27, 37 is variable, as a function of conventional vise grip pliers, so that hinge repair tool 10 may be used with any reasonably sized door hinge.

Figure 3:
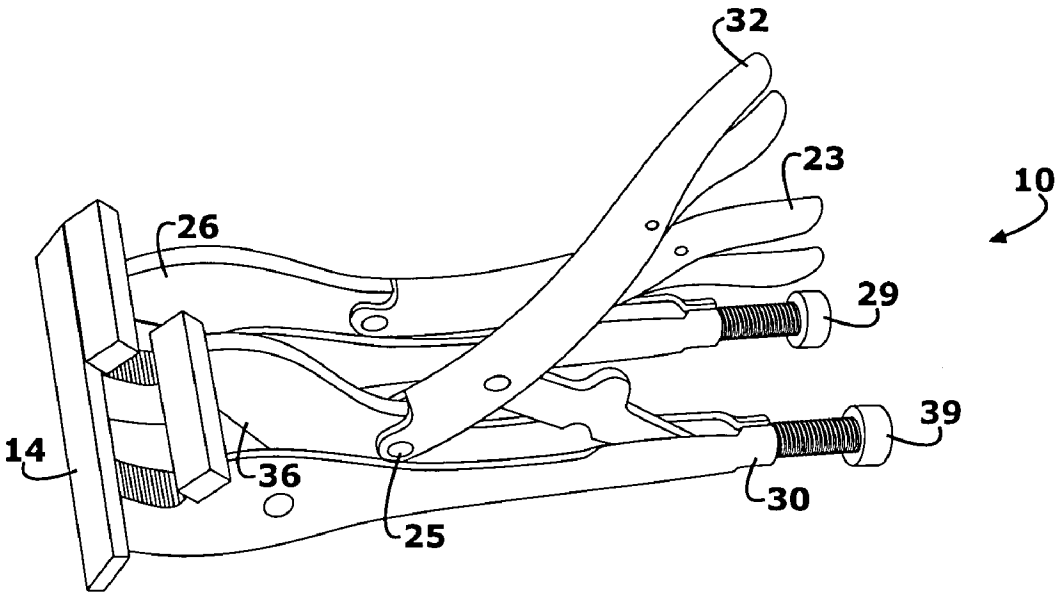
FIG. 3 is a perspective view of the hinge repair tool in its partially open position.

Referring now also to FIG. 3, there is shown a perspective view of hinge repair tool 10 in its half open position. While pair of pliers 30 has a handle 32 shown in its closed position in this FIGURE, the handle 22 of pair of pliers 20 is open (i.e., legs 23, 24 are separated). Thus, lower bar 27 is offset from upper bar 14, while lower bar 37 is clamped to upper bar 14. The first pair of pliers 20 is open for subsequent closing around a door hinge, while second pair of pliers 30 is shown in a closed position. This aforementioned configuration allows a user to clamp one of the pairs of pliers 30, for example, while manually adjusting the other pair of pliers 30. Independent handles 22, 32 and lower bards 27, 37 permit operation of tool 10 by the user with one or two hands.

Figure 4:
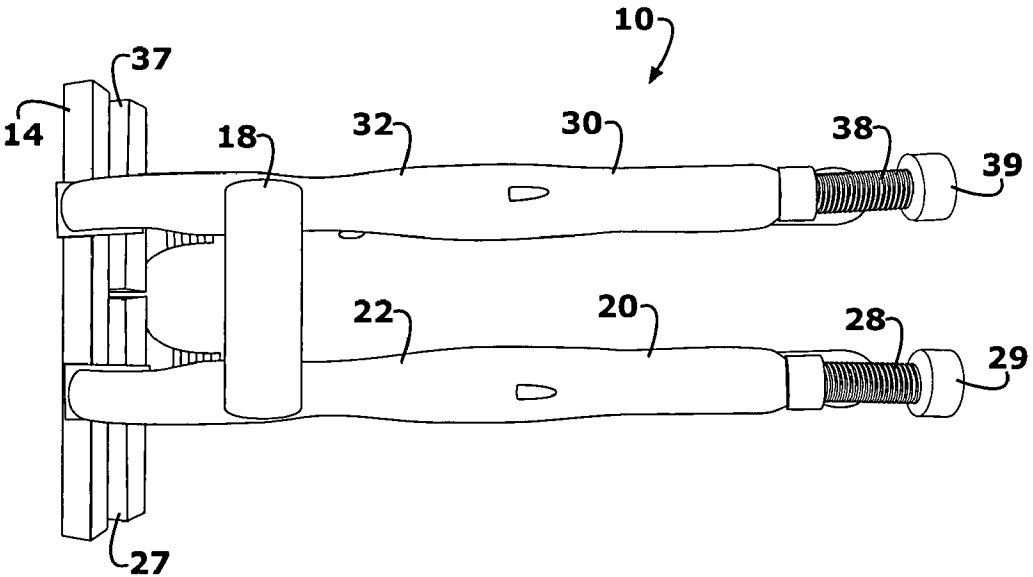
FIG. 4 is a plan view of the back of the hinge repair tool.

FIG. 4 is a plan view of the back of the hinge repair tool. A rigid, flat bar 18 is attached by conventional means to handles 22, 32 in order to support and stabilize handles 22, 32 with respect to one another.

In operation, a user first opens the legs 23, 24 and 33, 34 of both handles 22 and 32, respectively, and surrounds a hinge with upper bar 14 and lower bards 27, 37. One of the pairs of pliers 20 is then secured (clamped) around the hinge and the pair of pliers 20 is locked by locking mechanism 29. When the user desires to repair the hinge, he or she also clamps second pair of pliers 30 around the hinge and applies adjusting force to both pairs of pliers 20, 30. This hinge tool makes it possible to bend door hinges back to the original shape without removing them from the door. By using the handles, one than the other, one holding and one squeezing, the amount of pressure is multiplied and it is possible to straighten bent hinges without putting stress on the hinge pockets or the person using the tool. It also saves an enormous amount of time not having to remove and replace hinges. Doors that hit on the frame are repaired and swing correctly again and can close and latch properly.

Since other modifications and changes varied to fit particular operating requirements and environments will be apparent to those skilled in the art, this invention is not considered limited to the example chosen for purposes of this disclosure, and covers all changes and modifications which does not constitute departures from the true spirit and scope of this invention.

Having thus described the invention, what is desired to be protected by Letters Patent is presented in the subsequently appended claims.

What is claimed is:

1. A hinge repair tool comprising:

a) a first pair of modified vise grip pliers having a top jaw, a bottom jaw and a two-legged handle;

b) a second pair of modified vise grip pliers having a top jaw, a bottom jaw and a two-legged handle, said second pair of pliers being spaced apart from and parallel to said first pair of pliers;

c) a substantially planar, rigid, elongated, upper bar connected to both of said respective top jaws of said first and second pairs of pliers; and d) first and second substantially planar, rigid lower bars connected to respective lower jaws of said two pairs of pliers;

whereby each of said first and second pairs of pliers is operative independently of each other.

2. The hinge repair tool in accordance with claim 1, wherein said first and second substantially planar, rigid lower bars are separated from each other and a gap is formed therebetween.

3. The hinge repair tool in accordance with claim 1, further comprising:

e) a rigid bar connected to both of said handles for providing support therebetween.

4. The hinge repair tool in accordance with claim 1, wherein said substantially planar, rigid, elongated, upper bar is connected to said top jaws of each of said pairs of pliers by at least one of the group: welding, gluing, screwing, bolting, and crimping.

5. The hinge repair tool in accordance with claim 1, wherein said first and second substantially planar, rigid lower bars connected to respective lower jaws of said two pairs of pliers are connected to said respective lower jaws of each of said pairs of pliers by at least one of the group: welding, gluing, screwing, bolting, and crimping.

6. The hinge repair tool in accordance with claim 3, wherein said rigid bar is connected to said handles of each of said pairs of pliers by at least one of the group: welding, gluing, screwing, bolting, and crimping.

7. The hinge repair tool in accordance with claim 1, further comprising:

e) means for locking said lower jaw of at least one of said pair of pliers relative to said upper jaw thereof.

8. A hinge repair tool comprising:

a) at least two pairs of modified vise grip pliers, each of said pairs of pliers having a top jaw, a bottom jaw and a handle, each of said pair of pliers being spaced apart from and parallel to one another;

b) a rigid, upper bar connected to said respective top jaws of each of said pairs of pliers; and c) rigid lower bars connected to respective lower jaws of said at least two pairs of pliers;

whereby each of said pairs of pliers is operative independently of one another.

9. The hinge repair tool in accordance with claim 8, wherein said lower bars are transversely separated from one another, forming a gap therebetween.

10. The hinge repair tool in accordance with claim 8, further comprising:

c) a rigid bar connected to said handles of said at least two pairs of pliers for providing support therebetween.

11. The hinge repair tool in accordance with claim 8, wherein said upper bar is connected to said respective top jaws of each of said at least two pairs of pliers by at least one of the group: welding, gluing, screwing, bolting, and crimping.

12. The hinge repair tool in accordance with claim 8, wherein said lower bars are connected to said respective lower jaws of each of said pairs of pliers by at least one of the group: welding, gluing, screwing, bolting, and crimping.

13. The hinge repair tool in accordance with claim 10, wherein said rigid bar is connected to said respective handles of each of said at least two pairs of pliers by at least one of the group: welding, gluing, screwing, bolting, and crimping.

14. The hinge repair tool in accordance with claim 8, further comprising:

c) means for locking said lower jaw of at least one of said at least two pairs of pliers relative to said upper jaw.

* * * * *